United States Patent [19]

Lindmark et al.

[11] Patent Number: 4,537,562

[45] Date of Patent: Aug. 27, 1985

[54] PUMP

[76] Inventors: Malte Lindmark; Margareta Lindmark, both of Sibyllegatan 53, 114 43 Stockholm, Sweden

[21] Appl. No.: 582,896

[22] Filed: Feb. 23, 1984

[30] Foreign Application Priority Data

Jan. 5, 1982 [SE] Sweden ..... 8200028

[51] Int. Cl.[3] ..... F04B 1/28

[52] U.S. Cl. ..... 417/215; 417/488

[58] Field of Search ..... 417/486, 487, 488, 273, 417/215, 238

[56] References Cited

U.S. PATENT DOCUMENTS

| | | | |
|---|---|---|---|
| 1,631,425 | 6/1927 | Marcus et al. | 417/273 |
| 2,345,125 | 3/1944 | Huber | 417/273 |
| 2,447,467 | 8/1948 | Palm | 417/215 |
| 2,612,839 | 10/1952 | Denny | 417/486 |
| 3,174,436 | 3/1965 | Wanner | 417/273 |
| 3,681,919 | 8/1972 | Forster | 417/238 |

FOREIGN PATENT DOCUMENTS

| | | | |
|---|---|---|---|
| 400572 | 9/1922 | Fed. Rep. of Germany | 417/486 |
| 17584 | 5/1956 | Fed. Rep. of Germany | 417/486 |
| 1174615 | 7/1964 | Fed. Rep. of Germany | 417/486 |
| 2043574 | 12/1971 | Fed. Rep. of Germany | 417/488 |
| 1184586 | 7/1959 | France | 417/486 |
| 1224588 | 6/1960 | France | 417/488 |
| 168488 | 9/1921 | United Kingdom | 417/486 |
| 620430 | 3/1949 | United Kingdom | 417/486 |
| 812836 | 5/1959 | United Kingdom | 417/486 |

*Primary Examiner*—William L. Freeh

*Attorney, Agent, or Firm*—Burns, Doane, Swecker & Mathis

[57] ABSTRACT

Pump having an inlet through which passes a medium intended for pumping, and an outlet through which passes the pumped medium. A drive source acts upon a number of pumping organs, said pumping organs being arranged in pairs as to be actuated by at least two rotable shafts, in addition to which pairs of pumping organs are arranged by means of communicating vessels and are driven by a cam on each shafts. Four rotable shafts (10, 20, 30, 40) are so arranged as to each interact with four pumping organs each. A pumping unit of 16 pistons are thus created. Several pumping units can be added together into one pump.

14 Claims, 10 Drawing Figures

PUMP

TECHNICAL FIELD

The present invention relates to a pump, and in particular to a pump of such a kind as exhibits an inlet through which passes a medium intended for pumping, and an outlet through which passes the medium pumped by the pumping organs of the pump. The pump interacts for this purpose with a drive source acting upon a number of pumping organs included in the pump.

The present invention finds a particularly suitable application in so-called variable displacement pumps. In the case of such variable displacement pumps the active displacement must be capable of continuous regulation during operation from a maximum value down to a minimum value, said latter value being capable of being set so that no active or output displacement is produced.

DESCRIPTION OF THE PRIOR ART

Pumps of the nature described above have previously been disclosed in a larger number of different embodiments. As far as the variable displacement pumps are concerned, these may be divided into two main groups, being those with radially arranged pistons and those with axially arranged pistons.

Displacement pumps with axially arranged pistons are the most common because of their compact execution. The pumping organs are normally integrated with the same mechanical structural unit which exhibits the necessary control function for the regulation of the pump. Furthermore, the pistons usually act against a disc, the inclination of which in relation to the axis of rotation will determine the active displacement of each piston. At high operating forces within the medium, considerable forces will act via the pistons against the disc. Because of this, a high specification must be imposed on the bearing between the piston and the disc and on the axial bearing of the disc in the surrounding housing.

In this type of displacement pump it is usual for the pumping medium to serve also as a lubricant for the control mechanism which performs the control function, as a result of which the pump is sensitive to impurities in the pump medium. It should be noted that the pump itself is also able to generate wear products which can affect the more vulnerable times of equipment in the circuit.

A displacement pump with axially arranged pistons contains between five and nine pistons as a general rule, and because of the geometrical considerations involved a balance must be achieved between the number of pistons and its diameter. Pumps having different maximum displacements will thus require pump housings of different sizes, and the integration of the control mechanism with the pump function will mean that the size of all the components must be changed in conjunction with any change in the dimensioning of the maximum displacement of the pump.

Displacement pumps with axially arranged pistons have been found to exhibit a finite service life in respect of the axial bearing. At operating pressures in excess of 250 bar the normal rated service life of the bearing is usually sufficient for less than 10,000 hours running. The associated disadvantage has been reduced to a certain extent by taking measures to permit the replacement of axial bearings to take place in a simple fashion.

Previously disclosed in U.S. Pat. No. 3,013,498 is a displacement pump consisting of two parallel shafts with an arbitrary number of opposing pistons. Furthermore, the pistons also lie in the plane defined by the shafts. Phase displacement between the shafts is produced by means of a chain mechanism. The dimensioning of the component parts of the pump must be regarded as constituting a problem, especially when the pump is operating at high pressures. The piston forces will then have a parallel effect which will be applied cumulatively to each shaft. What this will mean in practice is that the shafts must be dimensioned for high loads and the associated rough dimensions, or that special restraints must be provided so as not to cause unacceptable deflection of the shafts.

It has been found desirable from the practical point of view to have at least five pistons so as to permit small pulsations to be produced in the flow. For a piston diameter of two centimeters and with five pistons arranged one next to the other, the load on the shaft will be about three tonnes at an operating pressure of 200 bar.

Previously disclosed in U.S. Pat. No. 3,704,080 is the design of a pulsation-free displacement pump by arranging pistons and cylinders to either side of one end of a lever capable of reciprocating movement, the other end of which bears against a cam disc.

Previously disclosed in U.S. Pat. No. 1,920,123 is a displacement pump having radially arranged pistons.

DESCRIPTION OF THE PRESENT INVENTION

Technical Problem

A pronounced desire and a technical problem associated with pumps of the type specified above is the creation of conditions such that a number of pumping organs or elements are able to act against one and the same rotatable shaft, in such a way as to permit the use of a number of pumping organs arranged in pairs.

A further pronounced desire is the creation of conditions such that a large number of pumping organs for pulse-free pumping can be used and driven by a small number of rotatable shafts.

A technical problem is associated with the creation of such conditions for a displacement pump that the actual pumping function and the control function can be separated from each other, and may preferably be executed within different mechanical structural units, thereby enabling service and inspection procedures to be improved and simplified.

A further technical problem is the creation of such conditions for a displacement pump that the control mechanism can be made entirely separate from the pump function, thereby enabling the pump to be designed and dimensioned for its intended purpose and the control mechanism to be designed and dimensioned for its intended purpose.

A further technical problem is encountered in conjunction with the arrangement of a separate pump function and a separate control mechanism in such a way that these are in the form of two autonomous structural units which shall be capable of being connected together by means of a mechanical interface.

A major technical problem has also been found to be associated with the creation of conditions such that a large number of pumping organs can be applied to and contained within a small geometrical unit, and also with the creation of conditions such as to permit the straightforward servicing and inspection of the different pumping organs.

A problem thus arises in conjunction with the design of the control system or the control mechanism and with the dimensioning of the latter such that it is capable of covering a wide operating range, i.e. pumps of different sizes. In this way a limited number of embodiments of the control mechanism will cover a large number of loading situations.

A technical problem is associated with the creation of conditions such that a large number of pump systems of different dimensions shall be capable of being combined with a relatively small number of control mechanisms.

A further technical problem is associated with the creation of a pumping system with several pumping organs buth without the need to make use of a complex, continuous workpiece in which various cavities and sliding surfaces must be positioned in a very precise relationship to each other. Instead, the design of the pump system must be provided by the use of a number of different flat profiles serving as structural elements, which themselves containing only imprecisely related cavities, said structural elements being capable of being connected together by the use of connecting elements to form a complete pump.

A complicated problem is encountered in conjunction with the ability to create conditions for a pump system composed of structural elements such that a small displacement of the separate elements, for example because of the varying elasticity of the seals, will not affect the function of the pump.

A major technical problem is associated with the design of an inexpensive pump constructed on the basis of the conditions indicated above and which must in addition be capable of covering a very wide range of applications.

A complex technical problem has been encountered in connection with the creation of conditions such that any eventual repairs may be carried out simply by replacing any defective component parts, with the dismantling and reassembly of the pump being possible without the need for expensive special tools.

SOLUTIONS

The present invention relates to a pump exhibiting an inlet through which passes a medium intended for pumping, and an outlet through which passes the medium pumped by the pumping organs of the pump, and a drive source acting on a number of pumping organs. It is also proposed that the pumping organs should be capable of being so arranged that they will act together in pairs, i.e. two pistons will work inside a communicating vessel. Pumping organs shall be so arranged that the pistons are positioned diametrically in relation to each shaft and are drive by a cam on said shaft.

The invention proposes that four rotatable shafts shall be used so that each and every one shall be capable of interacting with four pumping organs.

The shafts shall rotate at the same angular velocity, and the relative phase between them shall be capable of adjustment.

Adjustment of the phase is provided so as to permit the regulation of the flow of the medium or of the displacement through the outlet.

Each pumping organ consists of a cylinder formed inside a housing with a piston capable of reciprocating movement which fits inside the cylinder, said piston interacting for the purpose of its movement eccentrically with the axis of rotation of the shaft.

The invention also proposes that a pump housing intended for the pumping organs shall be formed from three different flat profiles serving as structural elements.

In the event of four rotatable shafts being used, it is proposed in particular that a diagonally arranged pair of shafts should form a rotating pair having the same direction of rotation and having a fixed internal phase of 180° (opposite phase) between the positions of the cams, whilst the second diagonally arranged pair of shafts should form a rotating pair having the same mutual direction of rotation and an internally fixed opposite phase. The first pair of shafts has a first direction of rotation whilst the second pair of shafts has an opposing direction of rotation. The phase of one of the pairs of shafts is adjustable in relation to the phase of the second pair of shafts.

ADVANTAGES

Those advantages which may principally be regarded as being associated with a pump in accordance with the present invention are that conditions are created in this way which will permit a large number of pumping organs to be arranged inside a housing having small external dimensions. The pump housing may also be built up from a small number of flat profiles serving as structural elements enabling the pump system to be separate from the control mechanism.

What may be regarded as the principal characteristic features of a pump in accordance with the present invention are indicated in the characterizing part of the following patent claim 1.

BRIEF DESCRIPTION OF THE DRAWINGS

A preferred embodiment exhibiting the significant characteristic features of the present invention is described in greater detail below with reference to the accompanying drawing, in which.

DESCRIPTION OF THE PREFERRED EMBODIMENT

Figure 1:
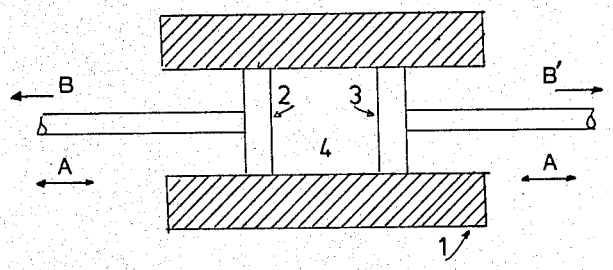
FIG. 1 shows an essentially previously disclosed representation of the construction of a variable displacement; pump.

FIG. 1 shows the principal construction and the function of a previously disclosed pump, said pump being capable with advantage of exhibiting the characteristic features associated with a variable displacement pump.

FIG. 1 thus illustrates the pumping organ in the form of a cylinder 1, into which are introduced two pistons, one having the reference designation 2 and one having the reference designation 3. The pistons 2 and 3 and the cylinder 1 together define a space 4.

If the pistons are caused to be displaced back and forth in the direction of the arrows "A", said displacement taking place in a synchronous fashion, the space 4 will be caused to move back and forth inside the cylinder 1 without any change in its volume. In the case of the synchronous movement of the pistons 2, 3 the output of the pump or the pumped displacement will be equal to zero.

If, on the other hand, the piston 2 were to be moved in the direction of the arrow "B" at the same time as the piston 3 were to be moved in the direction of the arrow "B", i.e. in a direction away from each other, it is obvious that the space 4 will be the subject of an increase in its volume. By means of inlet valves, not shown in FIG. 1, it is possible to cause the space 4 to be filled with a medium intended for pumping. In the presence of a reciprocating movement of the pistons 2 and 3, i.e. when these approach each other, the medium enclosed in the space 4 will be pumped out through an outlet valve, not shown in the Figure. The maximum pumping effect or indicated displacement will be achieved when the two pistons move in precisely opposite directions.

It is possible to select the phase displacement between the movement of the pistons in such a way that the generated or active displacement may vary from a maximum value determined by the design to a minimum value which may be selected so as to have zero value.

It is obvious that each such space 4 will require valves to be provided so as to permit the medium to flow into the cylinder and so as to permit the medium to flow out of the cylinder under pressure. These valves are not shown, however, in the interests of clarity, in addition to which valves of this kind are components which are already very familiar to the experts.

Figure 2:
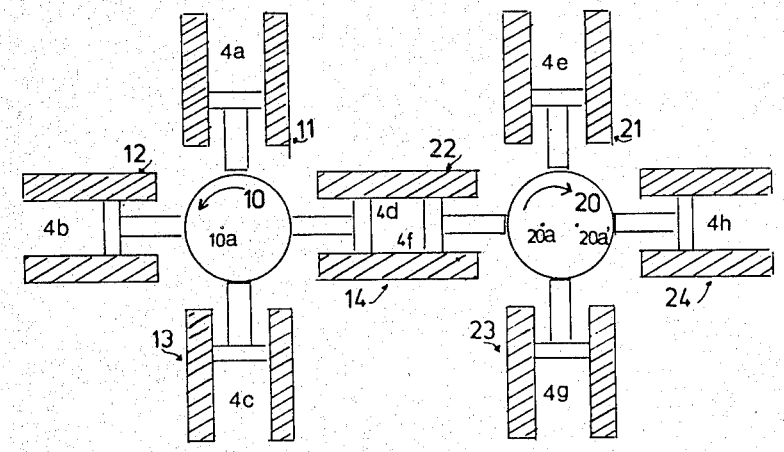
FIG. 2 shows a basic design in which several pumping organs are driven by two shafts.

With reference to the embodiment in accordance with FIG. 2, the principle illustrated in FIG. 1 has been utilized. In this case, however, two shafts 10 and 20 are shown, and each shaft actuates four pumping organs. The shaft 10 thus interacts with the pumping organs 11, 12, 13 and 14, and the shaft 20 interacts with the pumping organs 21, 22, 23 and 24.

It is also proposed that the pumping organs shall be capable of interacting two by two via communicating vessels. Pumping organs arranged in pairs 12, 14 and 22, 24 are positioned diametrically in relation to each shaft 10, 20 and are driven by a cam with eccentric points 10*a*, 20*a* on said shafts. Pumping organs are arranged between the shafts 10 and 20. These pumping organs consist of the organ 14 for the shaft 10 and of the organ 22 for the shaft 20 and interact with each other and utilize one and the same cylinder.

The shafts 10 and 20 must rotate at the same angular velocity and the relative phase between them mut be capable of being adjusted so as to permit the flow of the medium through the outlet to be controlled. If the cam 20*a* for the shaft 20 assumes the position shown in FIG. 2 no pumping will occur via the pumping organs 14 and 22, since the shafts 10 and 20 will be operating in phase. If, however, the position of the cam is changed from 20*a* to 20*a*', this means that the pumping organs 14, 22 will create maximum displacement into the space 4*d*+4*f*, since in this case a phase displacement of 180° will be present.

FIG. 2 thus shows that four pumping organs interact with each shaft and that an organ allocated to one shaft 10 interacts with an organ allocated to the second shaft 20, in such a way that the pumping organ 11 is in a relationship with the pumping organ 21, whilst the pumping organ 13 is in a relationship with the pumping organ 23 and finally that the pumping organ 12 is in a relationship with the pumping organ 24. Four communicating vessels are formed in this way.

Figure 3:
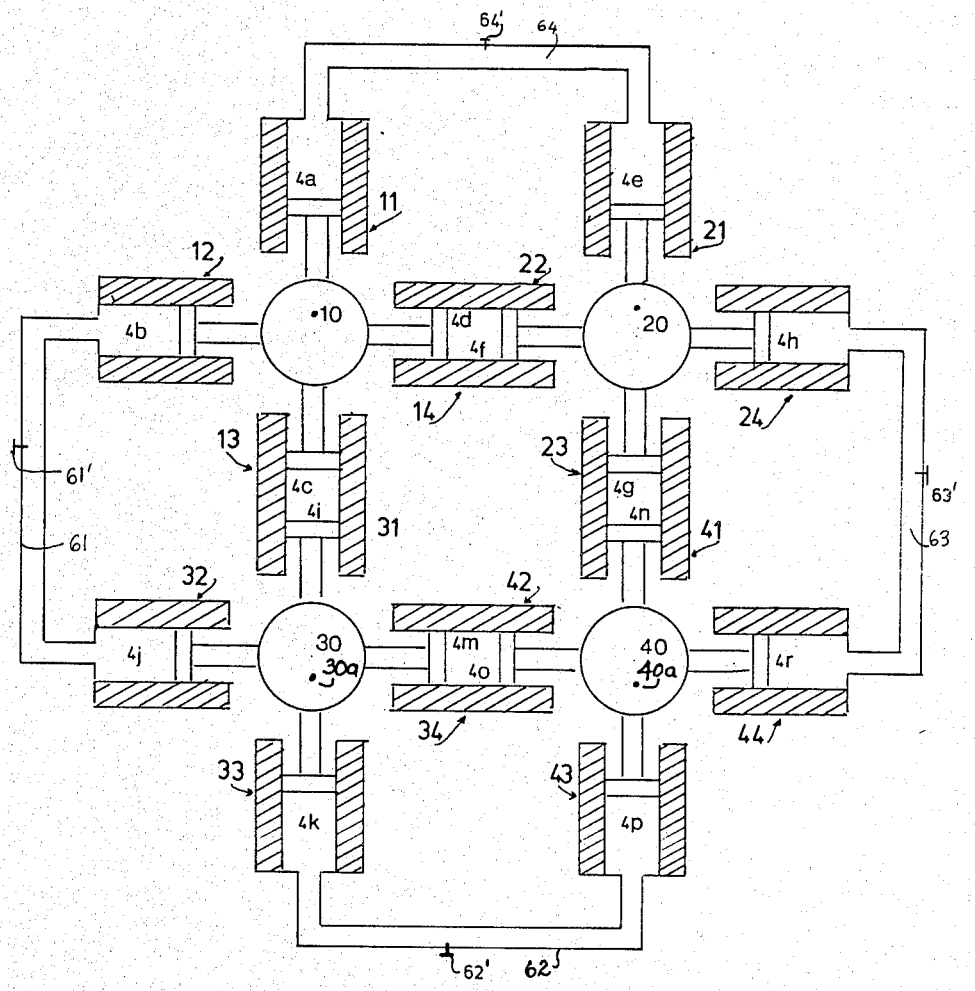
FIG. 3 shows an embodiment in accordance with the present invention having four shafts for driving several pumping organs.

FIG. 3 shows an embodiment designed in accordance with the principles of the present invention with four shafts 10, 20, 30 and 40. The shafts 10 and 20 interact with pumping organs in the manner already described with reference to FIG. 2, whilst the shaft 30 interacts with the pumping organs 31, 32, 33 and 34 and the shaft 40 interacts with the pumping organs 41, 42, 43 and 44. The pumping organ 31 exhibits a space 4*i*, the pumping organ 32 exhibits a space 4*j*, the pumping organ 33 exhibits a space 4*k* and the pumping organ 34 exhibits a space 4*m*, said space varying in relation to the displacement of the pistons, said displacement being related to the eccentric point 30*a* of the shaft 30. In a similar fashion a space 4*n* is formed in the pumping organ 41, a space 4*o* is formed in the pumping organ 42, a space 4*p* is formed in the pumping organ 43 and a space 4*r* is formed in the pumping organ 44, said spaces having a varying volume since the respective piston is related to an eccentric point 40*a* of the shaft 40.

The invention is based on an attempt to arrange communicating vessels for pumping organs, and it is obvious that the organs 13, 31; 14, 22; 23, 41 and 34, 42 constitute four such communicating vessels.

It is also proposed that the organs 11, 21; 12, 32; 24, 44 and 33, 43 must be in a relationship with each other via the pipework 64, 61, 63, 62. Appropriate check valves, four of which are shown schematically in conduits 61, 62, 63 and 64 as 61', 62', 63'and 64', respectively, are provided in the apparatus of FIG. 3.

Figure 4:
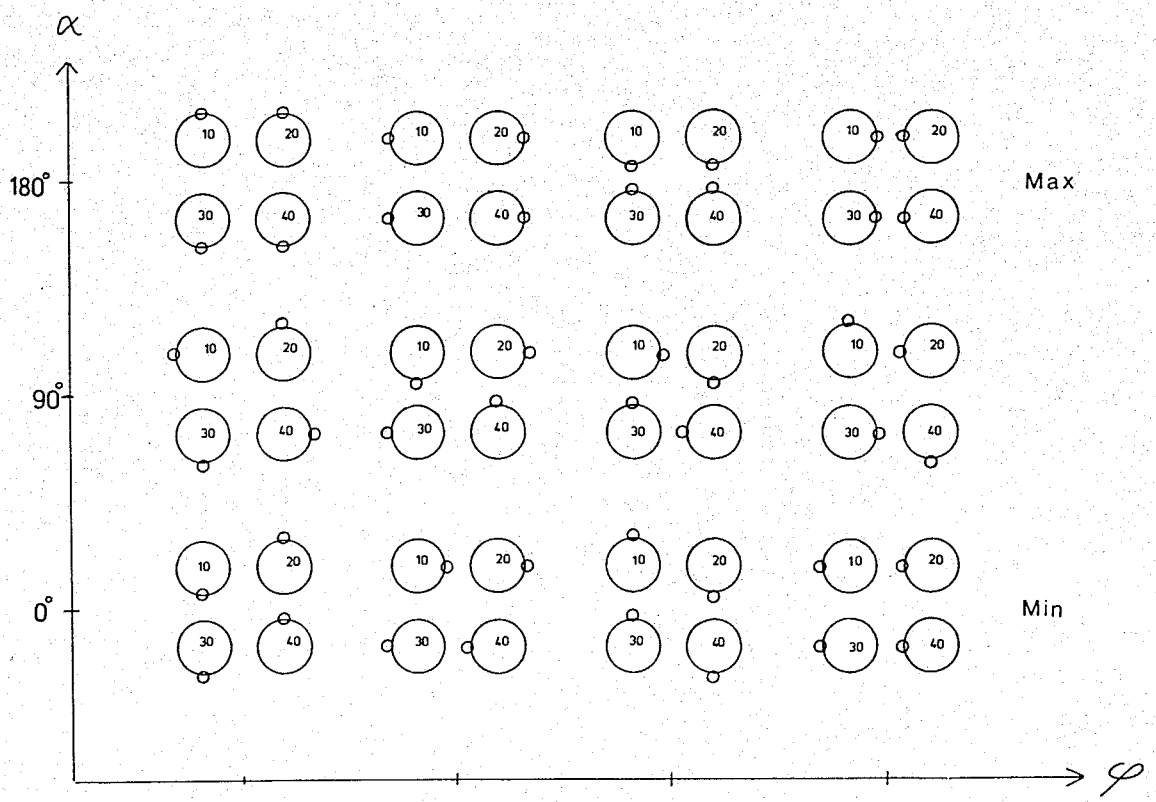
FIG. 4 shows the relative position of the four shafts in the embodiment in accordance with FIG. 3 for their mutual rotation and with different mutual phase displacement between pairs of shafts.

FIG. 4 illustrates the phase positions of the cams and the direction of rotation of the shafts, as well as the shafts which are to be rotated in phase in relation to each other for the purpose of enabling the control of the active displacement generated in the various communicating vessels.

First of all, the shafts 10, 20, 30 and 40 must rotate at the same angular velocity. Secondly, the shafts must form pairs when viewed diagonally. In FIGS. 3 and 4 the shafts 10 and 40 form a first such pair, whilst the shafts 20 and 30 form a second pair. Shafts forming one and the same pair shall have the same direction of rotation, and the relative phase within a pair must always be 180°.

The phase of 180° denotes that the maximum positions of the cams must always face in opposite directions.

In addition, the direction of rotation of the two pairs of shafts 10, 40 and 20, 30 must be in opposite senses. The relative phase between two pairs of shafts must be capable of adjustment to any desired position between 0° and 180°.

The adjustment of the relative phase will then affect the active displacement in an identical manner in all eight communicating vessels formed by the interacting pumping organs.

The movement pattern of the shafts 10, 20, 30 and 40 is apparent from FIG. 4, in which the indicated dashes mark the maximum positions of the cams. If a piston were to find itself directly in line with this position, then that piston would be in its most advanced position inside the cylinder, whilst on the opposite side is the minimum position of the cam, that is to say that if a piston is directly in line with this position, then that piston will be in its most retracted position.

FIG. 4 thus shows the relationship between the four shafts of the pump for one complete revolution. The horizontal shaft marks the position ($\phi$) at four times during one complete revolution. The vertical shaft marks three different conditions ($\alpha$) relating to the phase displacement between the pairs of shafts. Where $\alpha=180°$ the pumping organs will be operating in opposite phases in the respective communicating vessels. The active displacement will then be at its maximum value.

Where $\alpha=0$ the corresponding pumping organs will be operating in phase. The value of the active displacement will then be equal to zero.

The Figures also include the case in which the relative phase between the pairs of shafts is 90° and in which a certain active displacement occurs between interacting organs. In this case the displacement will be greater than 0 but will be less than for a phase displacement of 180°.

The displacement in the communicating vessels is a continous function of the phase displacement between the pairs of shafts and will undergo identical change in all the vessels.

Figure 5:
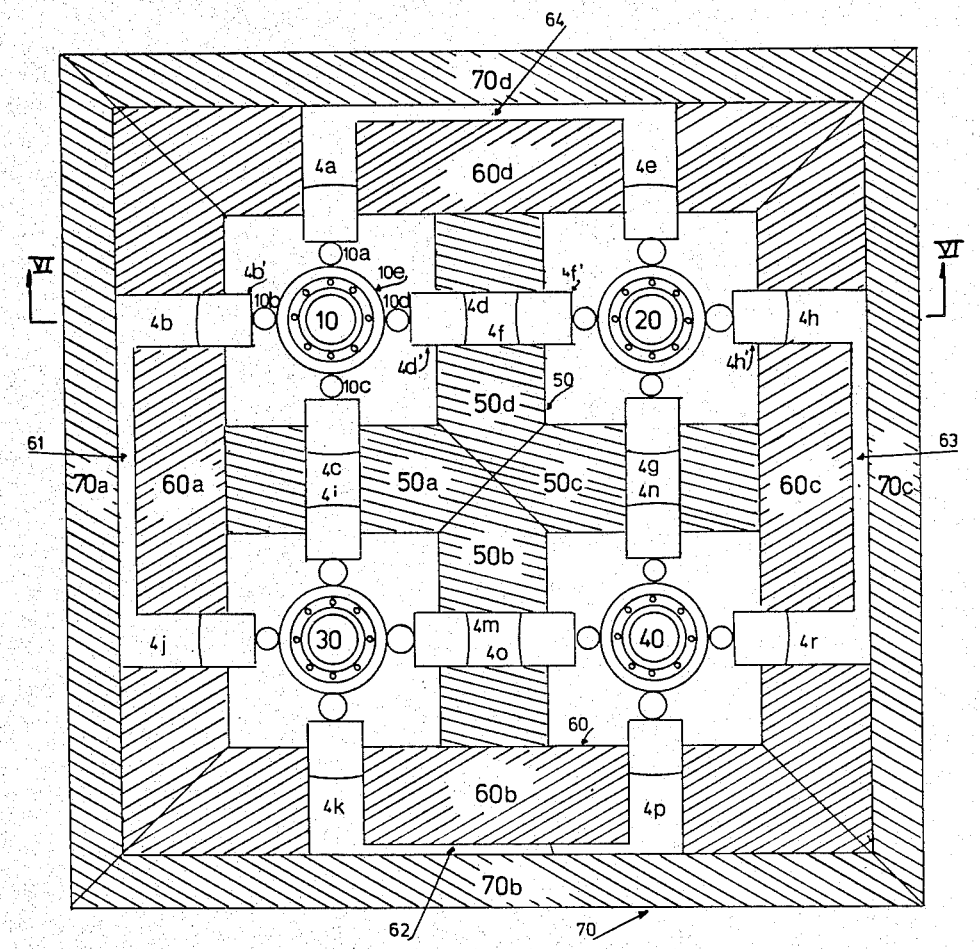
FIG. 5 shows a section through a pump housing produced in accordance with the principles shown in FIG. 3, said pump housing being executed from three different flat profiles serving as structural elements.

The mechanical structure of a pump in accordance with the principal of construction according to FIG. 3 is shown in FIG. 5. The Figure shows a radial section through the pump and illustrates the four parallel shafts 10, 20, 30 and 40 as well as the sixteen pumping organs in the form of pistons and cylinders, said pistons being actuated by cams formed on said shafts.

FIG. 5 shows a relationship between the space 4*a* and the space 4*e*, between the space 4*b* and the space 4*j*, between the space 4*k* and the space 4*p*, and between the space 4*r* and the space 4*h*. The necessary valves to permit the pumping function to take place are also not shown in FIG. 5. The return motion of the pistons may be provided by means of springs not shown in the Figure, said springs being positioned inside the cylinder and being so arranged as to interact with the top of the piston, when the spring will force the piston against the shaft.

The entire pump housing is produced as a unit by the use of three different profiles, to which the reference designations 50, 60 and 70 have been given. Of the first profile 50 are required four units or components 50*a*, 50*b*, 50*c* and 50*d*. Of the second profile 60 are required four units or components 60*a*, 60*b*, 60*c* and 60*d*. Finally, four units or components 70*a*, 70*b*, 70*c* and 70*d* are required of the third profile 70.

The cylinders included in the pumping organs are contained in two different types of profile executed in the form of structural elements, being the first profile with the reference designation 50 and the second profile with the reference designation 60. In the second profile 60 are two cylinders which communicate with each other via a transverse connection formed in the profile. In the first inner profile 50 is a transcurrent connection which serves as a cylinder for two interacting pistons. The third profile 70 which forms the outside of the pump housing is present for reasons associated with assembly and machining operations. The different units or components of the profiles 50, 60 and 70 form a unit with contains cylinders and flow channels, and the pump housing thus consists of four examples of each type of profile with the components 50*a*, 50*b*, 50*c* and 50*d* and 60*a*, 60*b*, 60*c* and 60*d* and 70*a*, 70*b*, 70*c* and 70*d*. In the profile components for the profiles 50 and 60 is a channel for the inlet and another for the outlet, each of said channels having been provided with a one-way control valve for regulating the flow of the liquid.

Figure 6:
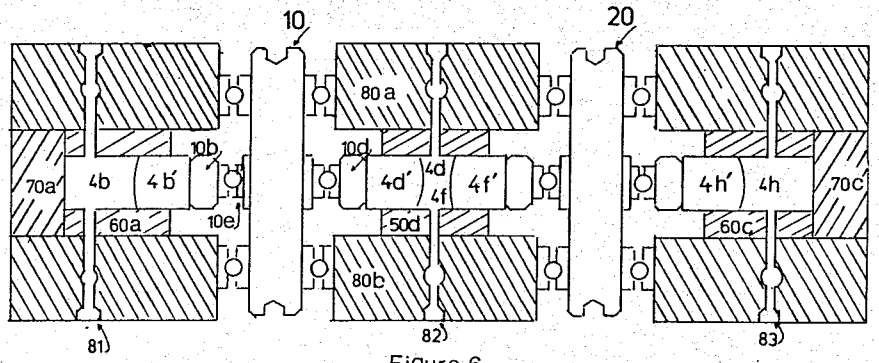
FIG. 6 shows a section VI—VI through the pump housing in accordance with FIG. 5.

FIG. 6 shows an axial section along the line VI—VI in FIG. 5, said section passing through the shafts 10 and 20. FIG. 6 also shows the pistons 4*b'*, *4d'*, *4f'* and 4*h'*. The spaces 4*b*, 4*d*, 4*f* and 4*h* are also shown.

The piston 4*b'* is actuated by the shaft 10 via an eccentrically supported ball bearing 10*e*, which makes contact with a similarly eccentrically supported roller 10*b*. The same is also true of the other pistons.

The shafts 10 and 20 are shown supported in two end pieces 80*a*, 80*b*. The end pieces also connect the different pump circuits via channels 81, 82 and 83.

All eight inlet lines and all eight outlet lines are normally connected in parallel, although it may be advisable in certain applications to have two or more separate pump circuits. To an end piece is connected the control unit, which is not shown in FIG. 6 but which has been given the reference designation 100.

The piston can be circular or non-circular. The advantage of non-circular pistons is that a larger displacement is easily obtained by lengthening the extension of the piston in the axial sense of the pump. The cross sectional dimension of the pump can thus be kept unchanged within certain limits in spite of the different displacement.

The method of causing the rotational movement of the shafts and the relative phase displacements may be resolved in accordance with various principles such as phase-controlled electric motors or mechanical differential gearboxes. From the point of view of cost and efficiency the most appropriate solution at the present time is to use a mechanical differential arrangement. The necessary technology is very familiar, and accordingly FIG. 7 provides only a diagrammatic representation of the manner in which such an arrangement can be constructed.

Figure 7:
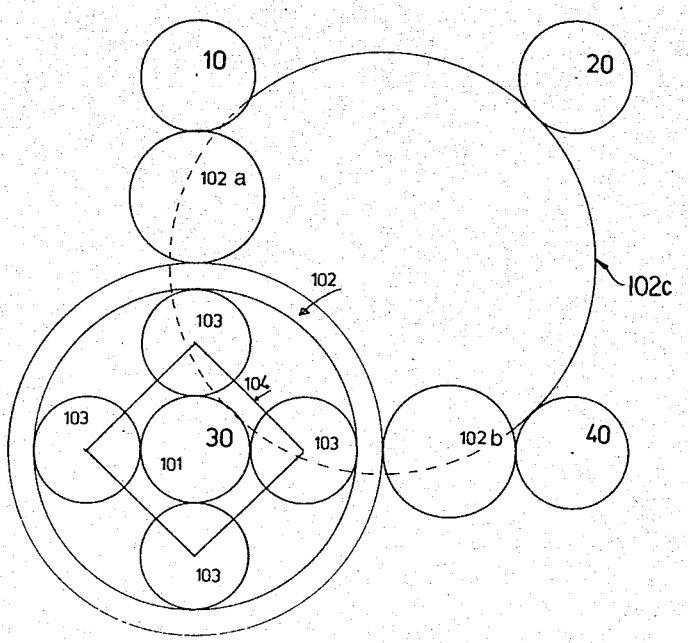
FIG. 7 shows the principal construction of a control mechanism for the control of the rotation of the shaft and the phase displacement of pairs of shafts in accordance with FIG. 4.

FIG. 7 may be assumed to show a radial section through a gearbox. An input shaft from an external power source is connected directly to a sun-wheel 101 and this then runs further to the pump and drives one of the four shafts, this being the shaft 30. The sun-wheel 101 is connected to a double-sided gear ring 102 via a number of planet wheels 103. These planet wheels 103 are supported in relation to each other in a rotatable frame 104. The gear ring 102 is connected to two gear wheels 102*a*, 102*b*, each of which engages with corresponding gear wheels on one of the pairs of shafts 10 and 40 of the pump. The second pair of shafts comprises the shaft 30 and the shaft 20. The latter are connected to each other via an intermediate gear 102*c*. The tooth pitch of all the constituent gear wheels shall be selected so that all the shafts 10, 20, 30 and 40 rotate at the same angular velocity. By turning the frame 104 the pair of shafts 10, 40 will change its phase angle in relation to the second pair of shafts 20, 30.

Figure 8:
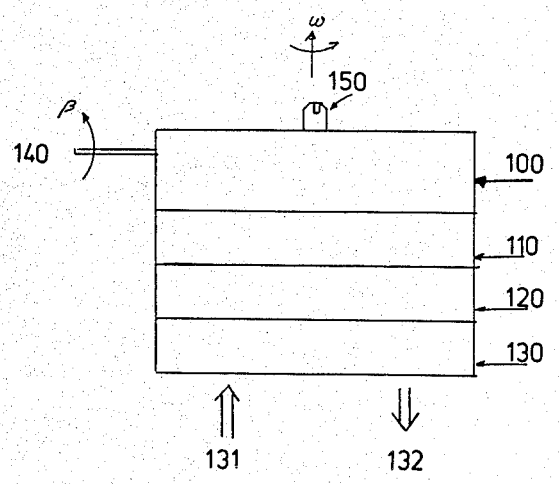
FIG. 8 shows a side view of a pump designed in accordance with the present invention.

A complete pump may be given the embodiment shown in FIG. 8, where three pump units 110, 120 and 130 forms a pump with an inlet 131 and an outlet 132 exhibit the component parts described with reference to the FIGS. 3, 4, 5 and 6 on which is positioned a combined gear and control unit 100, said unit being driven by a motor to the axis 150. The motor can be directly attached to the unit 100. The flow through the pump is regulated by turning the axis 140 to a certain fixed angular position.

Within the context of the invention also falls the possibility of increasing the flow of the medium in a simple fashion by the addition in the axial sense of the pump of one or more pieces of equipment or units in accordance with FIGS. 5 and 6.

The invention is not, of course, restricted to the embodiment described above by way of an example, but may undergo modifications. A number of pumping units may easily be connected together to cause a larger unit.

Figure 9:
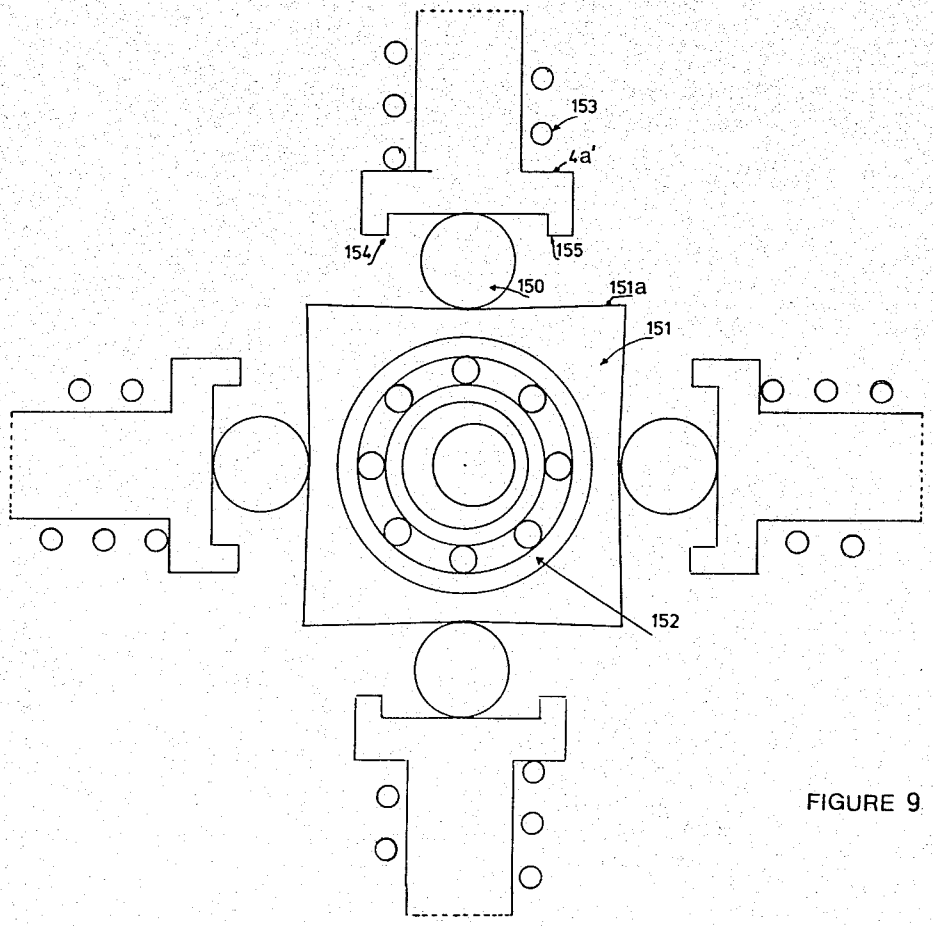
FIG. 9 shows a first embodiment of a cam arrangement for the actuation of a number of pumping organs incorporating pistons.

Various solutions exist for resolving the problem of the bearings between the cams of the shafts and thus between interacting pistons. A first embodiment is shown in FIG. 9. It is proposed here that a shaft 10 shall interact with an eccentrically mounted ball bearing 152. This ball bearing 152 supports an approximately square disc 151. The outer surface 151*a* of the disc forms a somewhat curved surface towards the centre for the purpose of guiding a cylinder 150. The cylinder 150 is positioned between the surface 151*a* and the lower part of the piston 4*a*'. A spring 153 forces the piston 4*a*' against the surface 151*a*. The lower part of the piston is also executed so as to exhibit projections 154 and 155 to hold the cylinder 150 against the surface 151*a*.

Figure 10:
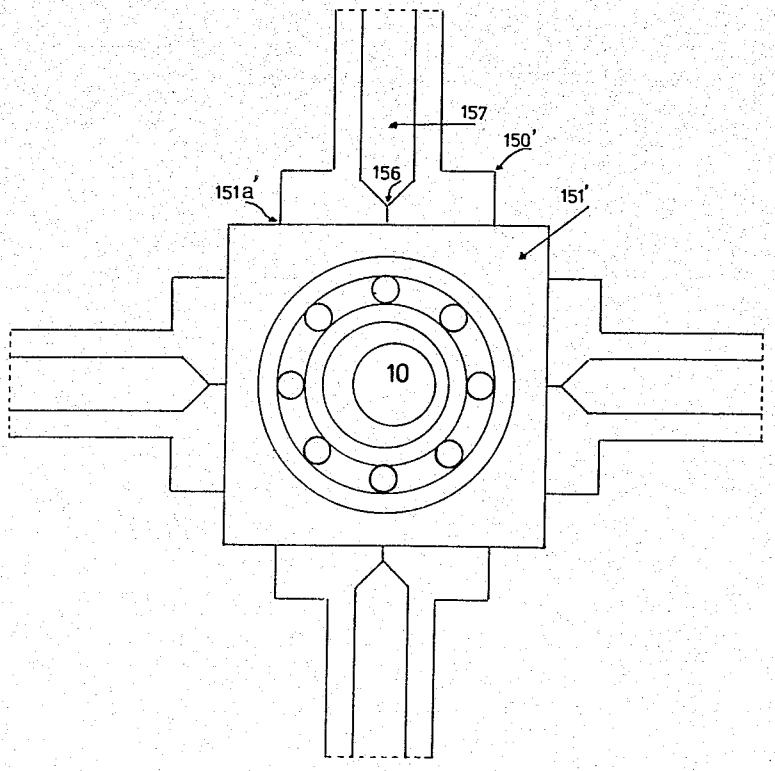
FIG. 10 shows a second embodiment of a cam arrangement for the actuation of a number of pumping organs incorporating pistons.

A second embodiment is shown in FIG. 10, and the bearing proposed in this case is in the form of a sliding shoe 150', which rests against an eccentrically supported four-sided disc 151'. The underlying principle is previously disclosed in U.S. Pat. No. 1,920,123. In order to facilitate lubrication between the sliding surfaces a channel 156 should be provided running up through the pistons towards the sliding surface 151*a*'. Thus, during the operating phase of the piston, hydrostatic lubrication of the disc 151' will take place.

It is proposed therefore, that that the piston be executed with a channel 157 which is connected with the cylinder and through which a lubricant can be forced.

Another method involves, in accordance with FIG. 5, placing a roller 10*a*, 10*b*, 10*c* and 10*d* between an eccentrically supported bearing 10*e* and the respective piston. Since the movements of the cam are small in relation to the diameter of the pistons, the rollers will maintain themselves around the central points of the pistons without passing beyond the side lines of the pistons. The ends of pistons adjacent the rollers may have an inwardly directed surface and projections on each side of the rollers, as described in the embodiment of FIG. 9, to maintain the rollers between the piston ends and the cam. This method of support can also be used when the pistons have been replaced by a membrane. The rollers may act directly against the membrane.

We claim:

1. A pump comprising an inlet through which passes a medium intended for pumping, and an outlet through which passes the medium pumped by the pumping elements of the pump, and a drive source acting upon four rotatable shafts having cams, said pumping elements arranged diametrically to each shaft so that they are driven by the cams on said shafts, said four rotatable shafts being situated so as to interact with a number of the pumping elements, a first diametrically arranged pair of said shafts constituting a rotating pair having the same direction of rotation and with a fixed opposite phase, a second diagonally arranged pair of said shafts constituting a similar rotating pair having the same mutual direction of rotation and with a fixed opposite relative phase, and wherein the first pair of shafts has a first direction of rotation while the second pair of shafts has an opposing direction of rotation, and wherein the phase of one of the pairs of shafts is adjustable in relation to the phase of the second pair of shafts.

2. Pump according to patent claim 1, characterized in that a pump housing intended for the pumping organs is executed with the help of a number of components formed from different flat profiles serving as structural elements.

3. Pump according to patent claim 1, characterized in that a control mechanism for regulating the flow of the medium is formed in one unit and is secured via an interface to a unit intended for the pumping organs.

4. Pump according to patent claim 1, characterized in that the flow of the medium from the pump via the outlet is capable of adjustment depending on the phase between the cams acting upon the shafts.

5. Pump according to patent claim 1, characterized in that each pumping organ consists of a cylinder formed inside a housing containing a piston capable of reciprocating movement inside the cylinder, said piston interacting for the purpose of its movement eccentrically with the axis of rotation of the shaft.

6. Pump according to patent claim 5, characterized in that a control mechanism for regulating the flow of the medium is formed in one unit and is secured via an interface to a unit intended for the pumping organs.

7. Pump according to patent claim 5, characterized in that the flow of the medium from the pump via the outlet is capable of adjustment depending on the phase between the cams acting upon the shafts.

8. Pump according to patent claim 1, characterized in that a pump housing intended for the pumping organs is executed with the help of a number of components formed from different flat profiles serving as structural elements.

9. Pump according to patent claim 8, characterized in that a control mechanism for regulating the flow of the medium is formed in one unit and is secured via an interface to a unit intended for the pumping organs.

10. Pump according to patent claim 8, characterized in that the flow of the medium from the pump via the outlet is capable of adjustment depending on the phase between the cams acting upon the shafts.

11. A pump according to claim 1, characterized in that the flow of the medium from the pump via the outlet is capable of adjustment depending on the phase between the cams acting upon the shafts.

12. Pump according to patent claim 1, characterized in that each pumping organ consists of a cylinder formed inside a housing containing a piston capable of reciprocating movement inside the cylinder, said piston interacting for the purpose of its movement eccentrically with the axis of rotation of the shaft.

13. Pump according to patent claim 12, characterized in that a control mechanism for regulating the flow of the medium is formed in one unit and is secured via an interface to a unit intended for the pumping organs.

14. Pump having an inlet through which passes a medium intended for pumping, and an outlet through which passes the medium pumped by the pumping organs of the pump, and a drive source acting on a number of pumping organs, in addition to which pairs of pumping organs are a rranged by means of communicating vessels and are driven by a cam on each shaft and are capable of actuation via two shafts, characterized in that four parallel drive shafts (10, 20, 30, 40) are so arranged as to form the corners of a square, in that each shaft actuates, via a cam mechanism, four individual pistons of circular or elliptical external section, with a total of sexteen pistons being present in a radial cross-section, in that the pistons are posititioned symmetrically around each shaft at an angle of 90° in relation to each other, in that the cylinders are connected together in pairs in such a way that eight communicating vessels are formed, in that the pistons actuated by adjacent shafts work in pairs inside these cylinders, in that the pump housing is constituted in its axial sense from flat profiles (50, 60 and 70) in such a way that said cylinders and connecting lines are enclosed inside the profiles, in that each communicating pair of cylinders is provided with an inlet line and an outlet line with the appropriate directional control valve.

* * * * *